US006901779B2

(12) United States Patent
Magee et al.

(10) Patent No.: US 6,901,779 B2
(45) Date of Patent: Jun. 7, 2005

(54) KEY STORAGE AND CONCEALMENT DEVICE

(76) Inventors: Brad Magee, 15 Stokes Dr., Stockbridge, GA (US) 30281; Dietrich Hoecht, 455 Hoke O'Kelly Mill Rd., Loganville, GA (US) 30052

( * ) Notice: Subject to any disclaimer, the term of this patent is extended or adjusted under 35 U.S.C. 154(b) by 0 days.

(21) Appl. No.: 10/354,577

(22) Filed: Jan. 30, 2003

(65) Prior Publication Data

US 2004/0149183 A1 Aug. 5, 2004

(51) Int. Cl.[7] ..... E05G 1/00

(52) U.S. Cl. ..... 70/63; 70/456 R; 70/DIG. 81; 109/23; 109/50; 109/54; 174/66; 220/242; 220/477; 312/204

(58) Field of Search ..... 70/63, 456 R, 70/DIG. 81; 109/22, 23, 50, 54; 174/66, 67; 220/3.3, 242, 241, 476, 477; 312/204

(56) References Cited

U.S. PATENT DOCUMENTS

| | | | | | |
|---|---|---|---|---|---|
| 2,138,416 | A | * | 11/1938 | Cox | 70/447 |
| 3,999,493 | A | | 12/1976 | Gulya | 109/23 R |
| 4,043,279 | A | | 8/1977 | Padgett | 109/50 |
| 4,083,314 | A | | 4/1978 | Garvin | 109/50 |
| 4,504,103 | A | | 3/1985 | Woedl | 339/34 |
| 4,593,541 | A | | 6/1986 | Hollis | 70/57 |
| 4,651,544 | A | * | 3/1987 | Hungerford | 70/63 |
| 4,821,652 | A | * | 4/1989 | Hoffman | 109/23 |
| 4,901,651 | A | * | 2/1990 | Herron | 109/54 |
| 4,970,349 | A | | 11/1990 | Jones | 174/67 |
| 5,243,135 | A | | 9/1993 | Shotey | 174/67 |
| 5,590,608 | A | * | 1/1997 | Yore et al. | 109/50 |
| 5,877,450 | A | | 3/1999 | Quin | 174/66 |
| 5,901,589 | A | * | 5/1999 | Cordero | 70/63 |
| 5,947,038 | A | * | 9/1999 | Smith | 109/50 |
| 5,955,702 | A | | 9/1999 | Grossman et al. | 174/66 |
| 6,405,861 | B1 | * | 6/2002 | Siler et al. | 206/317 |
| 6,494,070 | B1 | * | 12/2002 | Moss et al. | 70/423 |

* cited by examiner

*Primary Examiner*—Lloyd A. Gall
(74) *Attorney, Agent, or Firm*—Myers & Kaplan, LLC; Barry E. Kaplan; Ashish D. Patel

(57) ABSTRACT

A key storage and concealment device that effectively stores and conceals any type of key in an inconspicuous or unobtrusive fashion, wherein quick and convenient access thereto is permitted by only those informed of the device's presence, thus appeasing any trepidation of discovery by an unauthorized person.

14 Claims, 9 Drawing Sheets

Note: shelves, numerals 48 and 148, omitted for clarity

KEY STORAGE AND CONCEALMENT DEVICE

TECHNICAL FIELD

The present invention relates generally to key storage devices, and more specifically to a key storage and concealment device. The present invention is particularly suitable for, although not strictly limited to, storing and concealing conventional household keys.

BACKGROUND OF THE INVENTION

Homeowners and business owners typically utilize keyed entries to restrict access to protected valuables, personal items and/or restricted areas. Moreover, to prevent loss, misplacement, theft or unauthorized use of the keys utilized to open these keyed entries, many individuals will hide their keys in undisclosed locations, such as, clothing drawers, closets, shelves, food jars, behind picture frames, and/or on the top ledge of a door frame. Such locations, however, are inherently unsafe and indiscreet, as the keys are not concealed, but rather placed out of sight, and easily discoverable with minimal effort. When unused for an extended period of time, the owner may even be prone to forgetting where he last hid the key.

Additionally, homeowners and/or business owners usually possess spare keys for a variety of keyed entries and/or locks for use when the original keys have been lost or misplaced. Such spare keys are usually placed within readily accessible drawers, under mats, in plant pots, or some other familiar location, that permits a user to gain convenient access thereto when needed. Unfortunately, however, such obvious key placement locations are also susceptible to discovery by unwanted individuals, thus facilitating access, theft or unauthorized use of valuables or goods contained behind the keyed entry.

Although a variety of wall depositories capable of storing and concealing keys and/or other articles are available, many such devices possess inherent disadvantages that render their use highly inefficient, impractical and problematic. For instance, U.S. Pat. No. 3,999,493 to Gulya discloses a wall vault/safe that utilizes an electrical outlet cover plate to conceal a vault positioned therebehind. To access and/or place items within the vault of the Gulya device, a special key must be inserted into one of the faux-sockets, wherein the faux-socket possesses an inner locking-mechanism that, once unlocked, permits the entire device to rotate or swivel outwardly and downwardly to reveal the contents of the vault. To its disadvantage, however, the special key of the Gulya device, utilized to "unlock" the vault and access the contents thereof, contributes to the complexity of the device, and further presents the obvious problem of inaccessibility to the contents of the vault should the key ever be misplaced or lost. Additionally, due to the inherently bulky structure and complexity of the Gulya device, not only is installation of the device significantly tasking and invasive, but a substantial amount of "stud-free" and "insulation-free" space behind the wall must be present in order for the device to function properly, thus precluding convenient installation over, or in cooperation with, a pre-existing wall outlet.

U.S. Pat. No. 4,083,314 to Garvin discloses a wall repository that utilizes an electrical outlet cover plate for concealment of items placed within a container, wherein the container is dimensioned to be received within a conventional outlet receptacle box. To its disadvantage, however, the Garvin device requires the removal of a screw from the cover plate to access the container and its contents stored therebehind, thus rendering the process intrinsically tedious and inconvenient.

Therefore, it is readily apparent that there is a need for a key storage and concealment device that effectively and discreetly conceals any type of mechanical key therein, yet permits the key owner's expeditious access thereto, without concerns of obvious discovery by unauthorized persons.

BRIEF SUMMARY OF THE INVENTION

Briefly described, in a preferred embodiment, the present invention overcomes the above-mentioned disadvantages and meets the recognized need for such a device by providing a key storage and concealment device that effectively stores and conceals any type of mechanical key in an inconspicuous or unobtrusive fashion, wherein quick and convenient access thereto is permitted by only those informed of the presence and location of the device, thus appeasing any trepidation of discovery by an unauthorized person.

According to its major aspects and broadly stated, the present invention in its preferred form is a key storage and concealment device having, in general, a light switch cover plate, light switch lever, hinged door, and key-retaining means.

More specifically, the present invention is a key storage and concealment device possessing a light switch cover plate having a door in hinged communication therewith, wherein a light switch lever in contact with the hinged door permits the opening and closing thereof. Positioned on the rear of the door, opposite the light switch lever, are retaining means, preferably in the form of retaining clasps, wherein the retaining clasps preferably function to receive and secure therein a variety of conventional keys for mechanical locks.

A feature and advantage of the present invention is its ability to inconspicuously store and conceal any type of key utilized to open a mechanical lock, including, but not limited to, household keys, flat keys, tube keys, mortice keys, cylinder keys, rim keys, padlock keys and automotive keys.

A feature and advantage of the present invention is its ability to function as an aesthetically unobvious key safe, thus avoiding attraction and/or discovery of a key retained therein.

A feature and advantage of the present invention is its ability to be installed in place of a conventional functional light switch cover plate.

A feature and advantage of the present invention is its ability to be installed anywhere on the interior and/or exterior of a building structure.

A feature and advantage of the present invention is its ability to reduce or eliminate potential loss, misplacement or theft of original or spare keys.

A feature and advantage of the present invention is its simplicity of design.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing Figures, in which like reference numerals denote similar structures and refer to like elements throughout, and in which.

DETAILED DESCRIPTION OF THE PREFERRED AND ALTERNATIVE EMBODIMENTS

Figure 1:
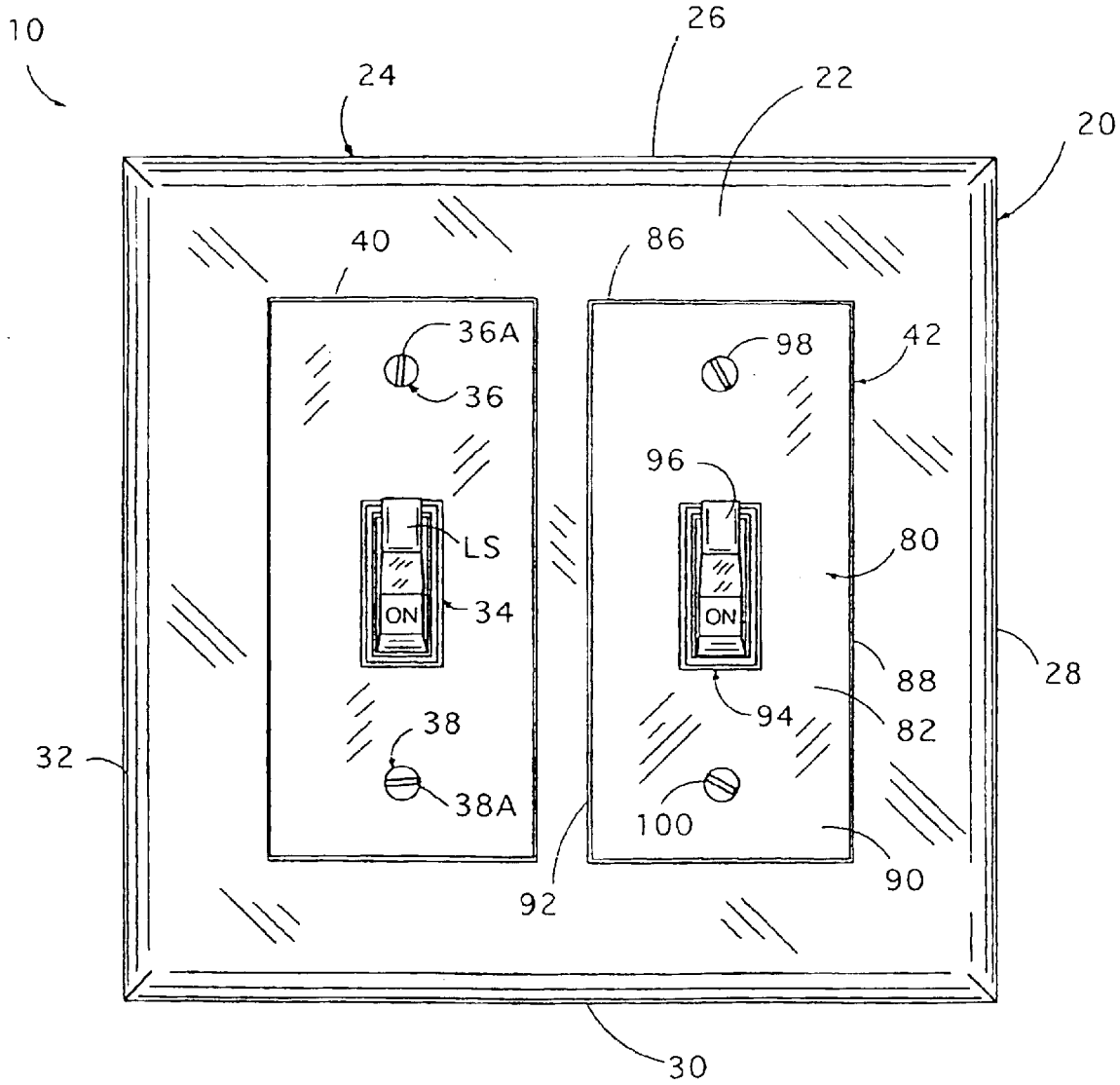
FIG. 1 is a front view of a key storage and concealment device according to a preferred embodiment of the present invention.

In describing the preferred and representative alternate embodiments of the present invention, as illustrated in FIGS. 1–9C, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–5, the present invention in a preferred embodiment is a key storage and concealment device 10 having, in general, light switch cover plate 20, hinged door 80, and key-retaining clasps 120, 130.

Light switch cover plate 20 is preferably similar in size and shape to a dual-lever conventional light switch cover plate as known within the art, having front surface 22, rear surface 24, first edge 26, second edge 28, third edge 30 and fourth edge 32, wherein edges 26, 28, 30, 32 are appropriately beveled and contoured such that rear surface 24 is disposed rearwardly for bearing against a wall surface, as known within the art.

Preferably, aperture 34 formed through cover plate 20, proximal to fourth edge 32, is dimensioned to adapt a conventional, fully functional and electrically coupled lever-type light switch LS. Throughholes 36, 38 positioned proximal to aperture 34 preferably receive screws 36A, 38A to assist in securing cover plate 20 to a conventional light switch receptacle (not shown) as known within the art. As best illustrated in FIG. 1, preferably encompassing aperture 34, is rectangular-shaped groove 40 formed on front surface 22 of cover plate 20, wherein groove 40 functions primarily to aesthetically compensate for the inherent surface incongruities formed between hinged door 80 sitting substantially flush with cover plate 20, thus permitting the function/presence of hinged door 80 to remain undetected, as more fully described below.

Figure 2:
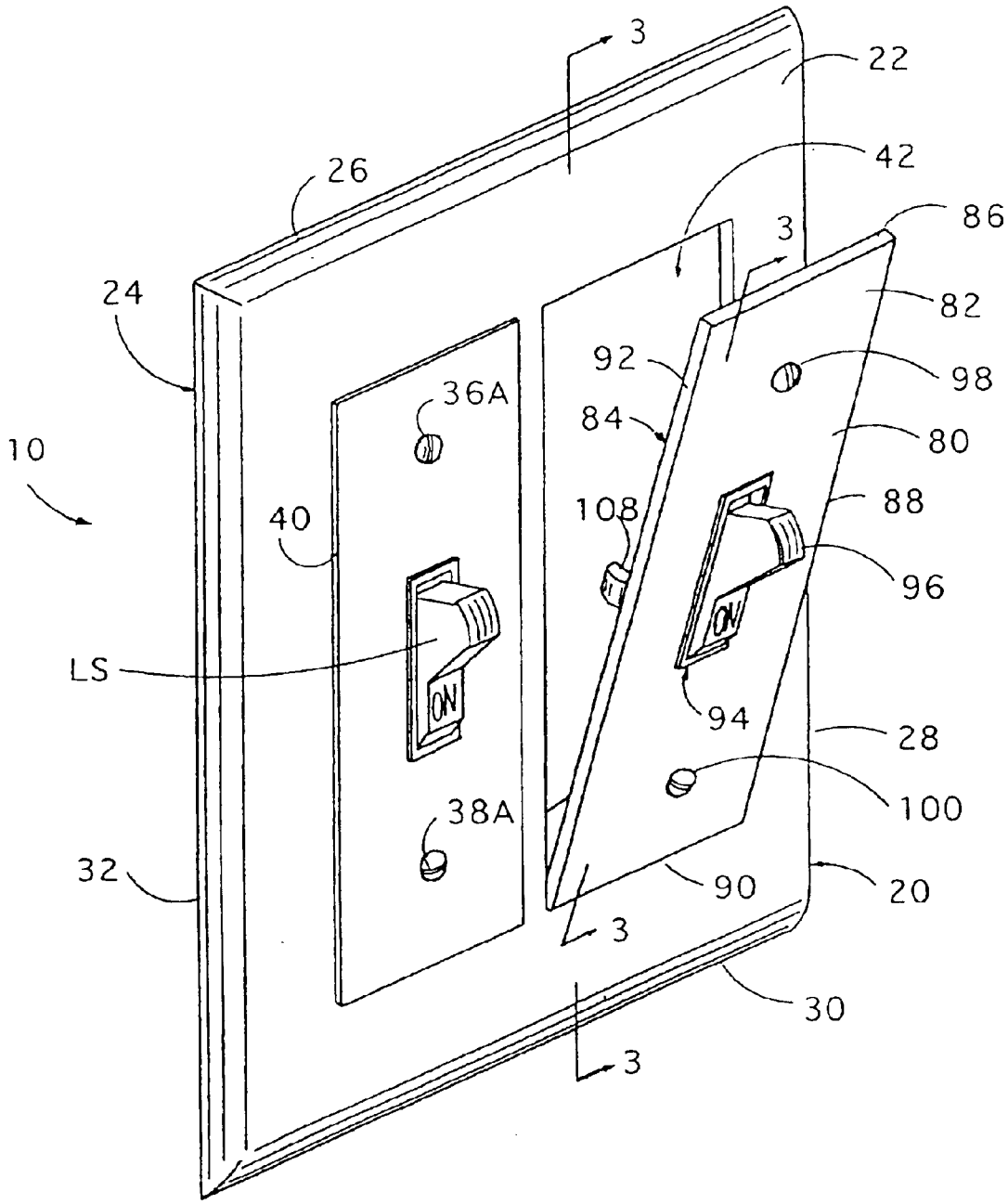
FIG. 2 is a perspective view of a key storage and concealment device according to a preferred embodiment of the present invention.

Preferably, rectangular-shaped aperture 42 formed through cover plate 20, proximal to second edge 28, is dimensioned to adapt rectangular-shaped, preferably hinged door 80 thereto, as best illustrated in FIG. 2. Preferably hinged door 80 possesses front surface 82, rear surface 84, first edge 86, second edge 88, third edge 90 and fourth edge 92. Preferably centrally formed through door 80 is rectangular-shaped aperture 94 through which faux light switch 96 fixedly extends, wherein light switch 96 is preferably a non-operational and electrically uncoupled lever-type light switch. Although light switch 96 is preferably fixedly positioned within aperture 94, it is contemplated in an alternate embodiment that light switch 96 could be pivotally secured within aperture 94 and/or electrically coupled and functionally operative therein and therethrough. Faux-screw heads 98, 100 positioned on front surface 82 of door 80, proximal to aperture 94, preferably function to give door 80 an aesthetically deceiving appearance of a conventional light switch-cover plate combination as known within the art.

Figure 3:
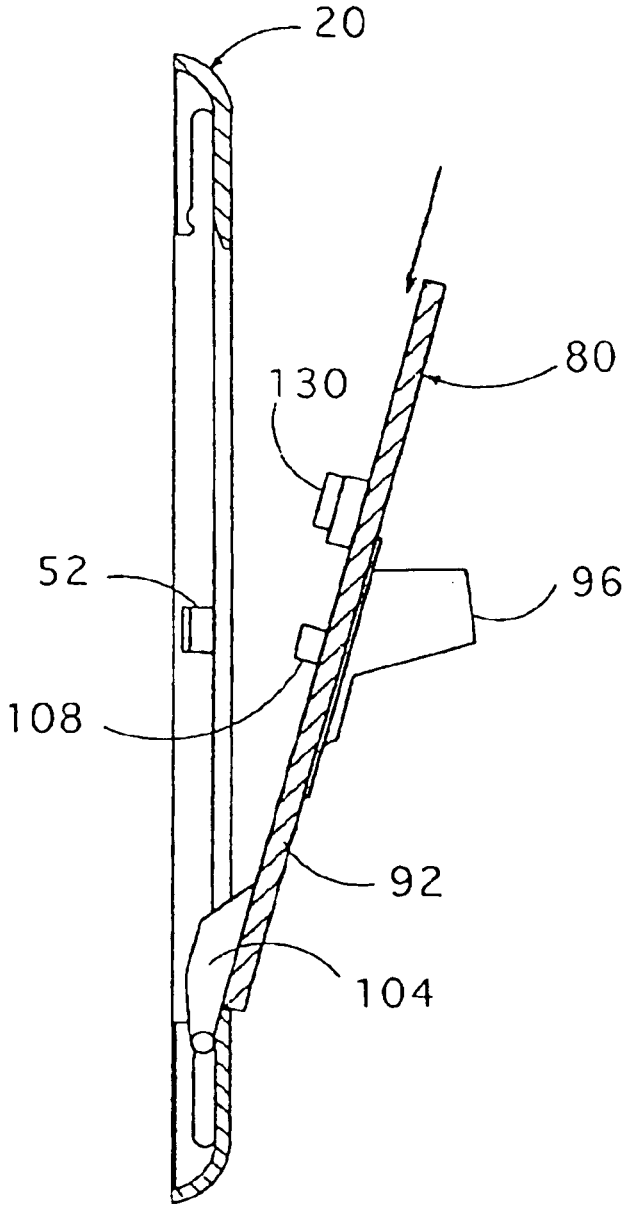
FIG. 3 is a cross-sectional view along section line 3—3 of FIG. 2 of a key storage and concealment device according to a preferred embodiment of the present invention.
Figure 4:
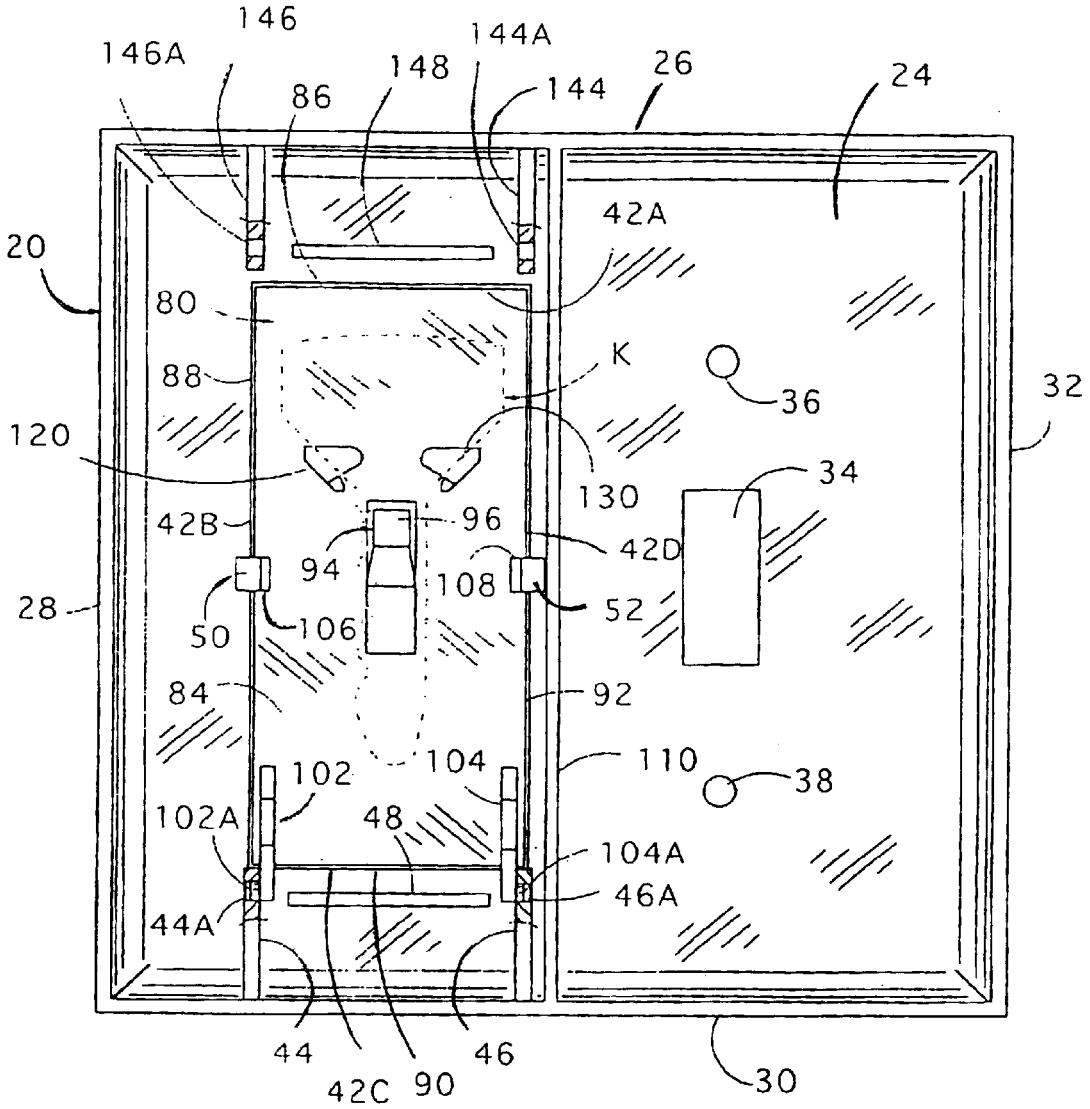
FIG. 4 is a rear view of a key storage and concealment device according to a preferred embodiment of the present invention.

As best seen with reference to FIGS. 3–4, preferably partially formed on rear surface 84 of door 80, proximal third edge 90 and extending therepast, are flanges 102, 104, wherein flanges 102, 104 are preferably positioned proximal to edges 88, 92, respectively, of door 80, and further preferably possess outwardly projecting, dowel-shaped protrusions 102A, 104A, respectively. Preferably protrusions 102A, 104A of flanges 102, 104, respectively, are hingably or pivotally engageable with throughholes or notches 44A, 46A formed through door supports 44, 46, wherein door supports 44, 46 are formed on rear surface 24 of cover plate 20, proximal third edge 30, and extend upwardly therefrom to third edge 42C of aperture 42, as best illustrated in FIG. 4.

Preferably also formed proximal to third edge 42C of aperture 42 is retaining shelf 48, wherein retaining shelf 48 preferably enables the capture and retention of key K thereon should a user of device 10 accidentally drop key K upon attempting to place key K within retaining clasps 120, 130, as more fully described below.

Preferably formed approximately midway through the length of edges 88, 92 of door 80 are frictional protuberances 106, 108, respectively, wherein frictional protuberances 106, 108 frictionally engage hook-shaped stops 50, 52 formed approximately midway through the length of edges 42B, 42D, respectively, of aperture 42, thus permitting door 80 to rest thereagainst when in the closed position.

Preferably, door supports 144, 146 are formed on rear surface 24 of cover plate 20, proximal first edge 26, and extend downwardly therefrom, to first edge 42A of aperture 42, as best illustrated in FIG. 4. Protrusions 102A, 104A of flanges 102, 104, respectively, are also preferably hingably or pivotally engageable with throughholes or notches 144A, 146A respectively formed through door supports 144, 146. Similarly, also preferably formed proximal to first edge 42A of aperture 42 is retaining shelf 148, wherein retaining shelf 148 also preferably enables the capture and retention of key K thereon should a user of device 10 accidentally drop key K upon attempting to place key K within retaining clasps 120, 130, as more fully described below. Such an overall configuration permits inversion of cover plate 20 for purposes of facilitating user-selectable installation of device 10, or amenable installation of device 10, in general, over light switch receptacles where the user desires, or installation requires, that hinged door 80 be on the left or right side of a dual-light switch receptacle, as frontally viewed.

As best illustrated in FIG. 4, preferably centrally formed on rear surface 24 of cover plate 20, and positioned parallel with second edge 28 and fourth edge 32 of cover plate 20, is barrier wall 110, wherein barrier wall 110 preferably extends from first edge 26 of cover plate 20 to third edge 30, also of cover plate 20. Furthermore, barrier wall 110 preferably outwardly protrudes from rear surface 24 no further than edges 26, 28, 30, 32, and, thus, is disposed substantially flush therewith; although, barrier wall 110 could be any suitable height. Preferably, barrier wall 110 functions primarily to obstruct passage of key K into an adjacent and electrically-operative light switch receptacle, should a user of device 10 accidentally drop key K upon attempting to place key K within retaining clasps 120, 130, as more fully described below. Barrier wall 110 further functions to prohibit ill-conceived probing of an adjacent and electrically-operative light switch receptacle, as by an unknowing child.

Preferably, rear surface 84 of hinged door 80 possesses retaining clasps 120, 130 formed thereon, positioned proximal to second edge 88 and third edge 92, respectively, of hinged door 80, wherein retaining clasps 120, 130 are preferably substantially L-shaped and bracket-like, and are preferably positioned a sufficient distance apart and in depth to facilitate the retention of key K placed therein.

Although retaining clasps 120, 130 are preferably L-shaped or bracket-like to facilitate the accommodation and retention of flat mechanical keys K therein, it is contemplated in an alternate embodiment that retaining clasps 120, 130 could be any shape and/or size to facilitate the accommodation and retention of any type of key, such as, for exemplary purposes only, any household keys, any flat keys, tube keys, mortice keys, cylinder keys, rim keys, padlock keys, automotive keys, or electronic key cards. Moreover, although retaining clasps 120, 130 are the preferred means of key retention, it is contemplated in another alternate embodiment that rear surface 84 of hinged door 80 could possess any number and type of retaining clasps, such as, for exemplary purposes only, a single retaining bar, a plurality of L-shaped brackets, adjustable clasps to accommodate keys having heads of different widths, and/or a pocket-like member for receiving the tip or a medial portion of key K. It is contemplated in still another alternate embodiment that rear surface 84 of hinged door 80 could possess any number and type of retaining clasps to facilitate the accommodation of a plurality of keys K in either a stacked fashion or in an adjacently positioned fashion.

Figure 5:
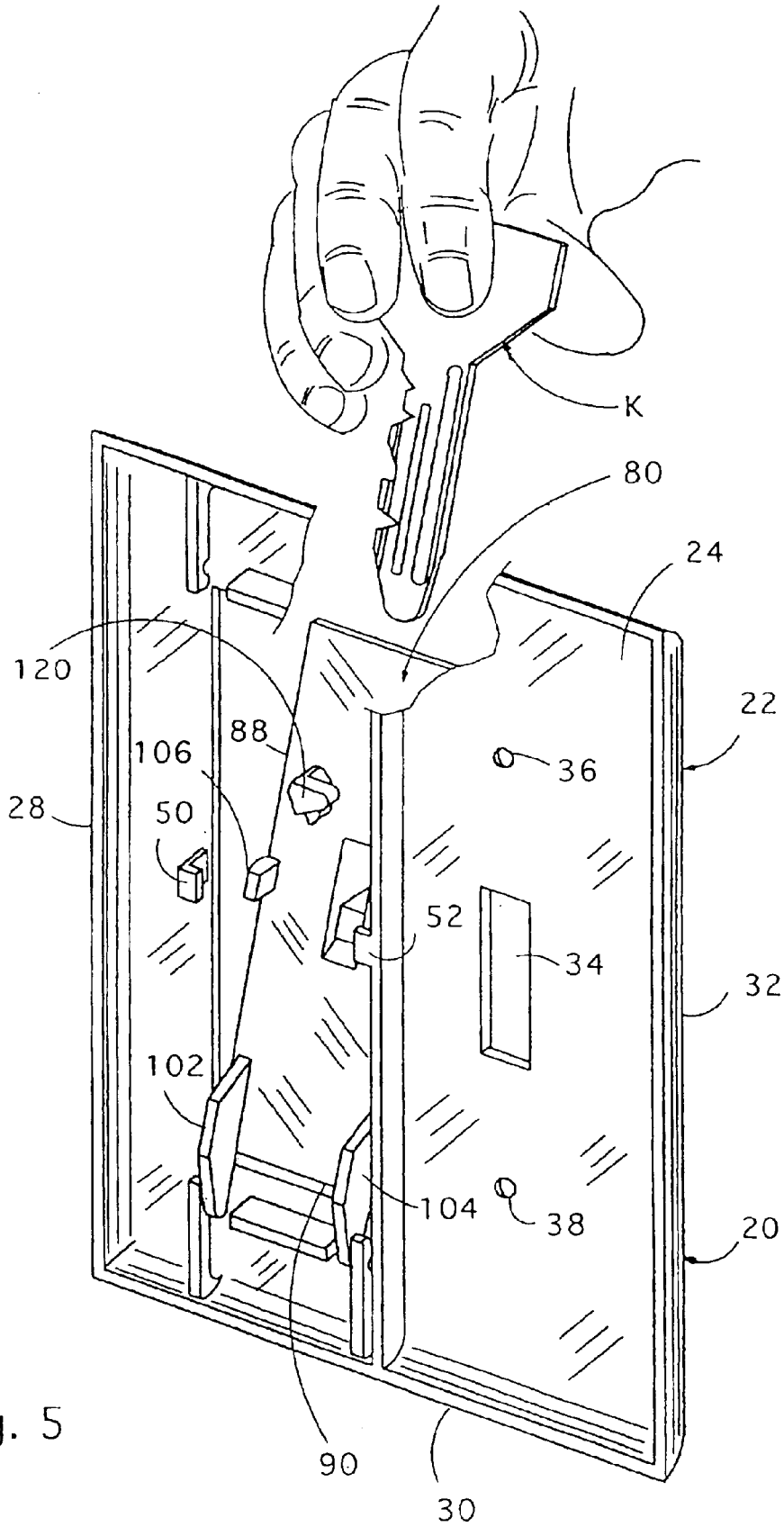
FIG. 5 is a perspective view of a key storage and concealment device according to a preferred embodiment of the present invention.

Referring now more specifically to FIG. 5, in use, a user of device 10 preferably pivotally opens hinged door 80 via utilizing fixed light switch 96 as a handle or lever. Thereafter, the user preferably slidably engages key K within retaining clasps 120, 130 for retention of key K therewithin and therebetween. Following insertion of key K into retaining clasps 120, 130, the user preferably closes hinged door 80, wherein hinged door 80 is frictionally held in an upright and closed position via the frictional interaction between frictional protuberances 106, 108 and hook-shaped stops 50, 52, respectively. To access key K, the user preferably pivotally opens hinged door 80, slidably removes key K therefrom, and re-closes hinged door 80.

Figure 6:
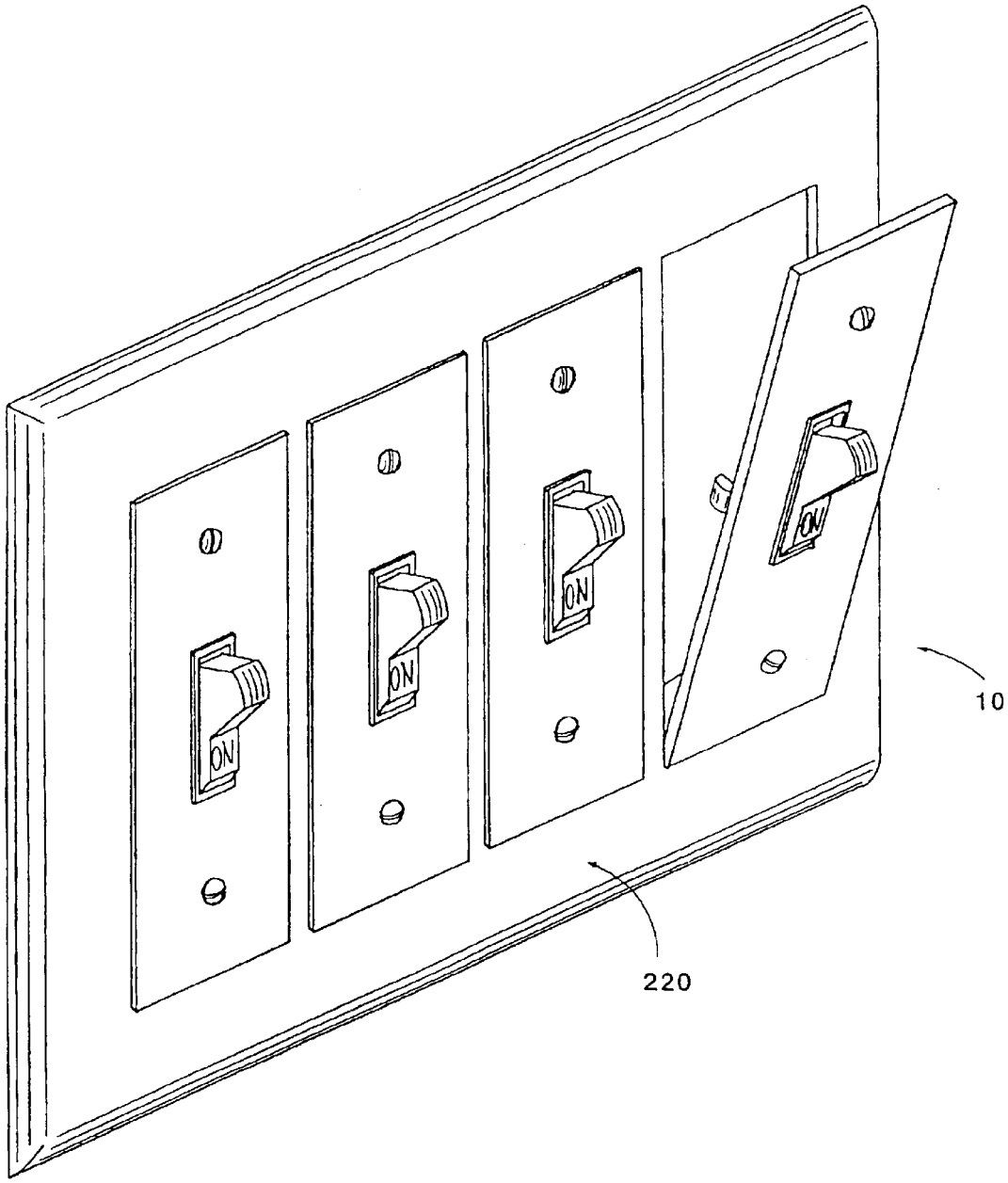
FIG. 6 is a perspective view of a key storage and concealment device according to an alternate embodiment of the present invention.

Referring now more specifically to FIG. 6, illustrated therein is an alternate embodiment of device 10, wherein the alternate embodiment of FIG. 6 is substantially equivalent in form and function to that of the preferred embodiment detailed and illustrated in FIGS. 1–5 except as hereinafter specifically referenced. Specifically, the embodiment of FIG. 6 incorporates a cover plate 220, wherein cover plate 220 is similar in size and shape to a multi-lever conventional light switch cover plate as known within the art. As illustrated in FIG. 6, cover plate 220 permits installation of device 10 over a light switch receptacle having three functional and electrically-coupled light switches extending therefrom. It is contemplated in an alternate embodiment that device 10 could manufactured to possess cover plates capable of accommodating any desired number of light switches. While illustrated in the outmost right-side position, it is further contemplated that the relative position of device 10 could be varied to accommodate placement within any alternate position in the multi-lever form.

Figure 7:
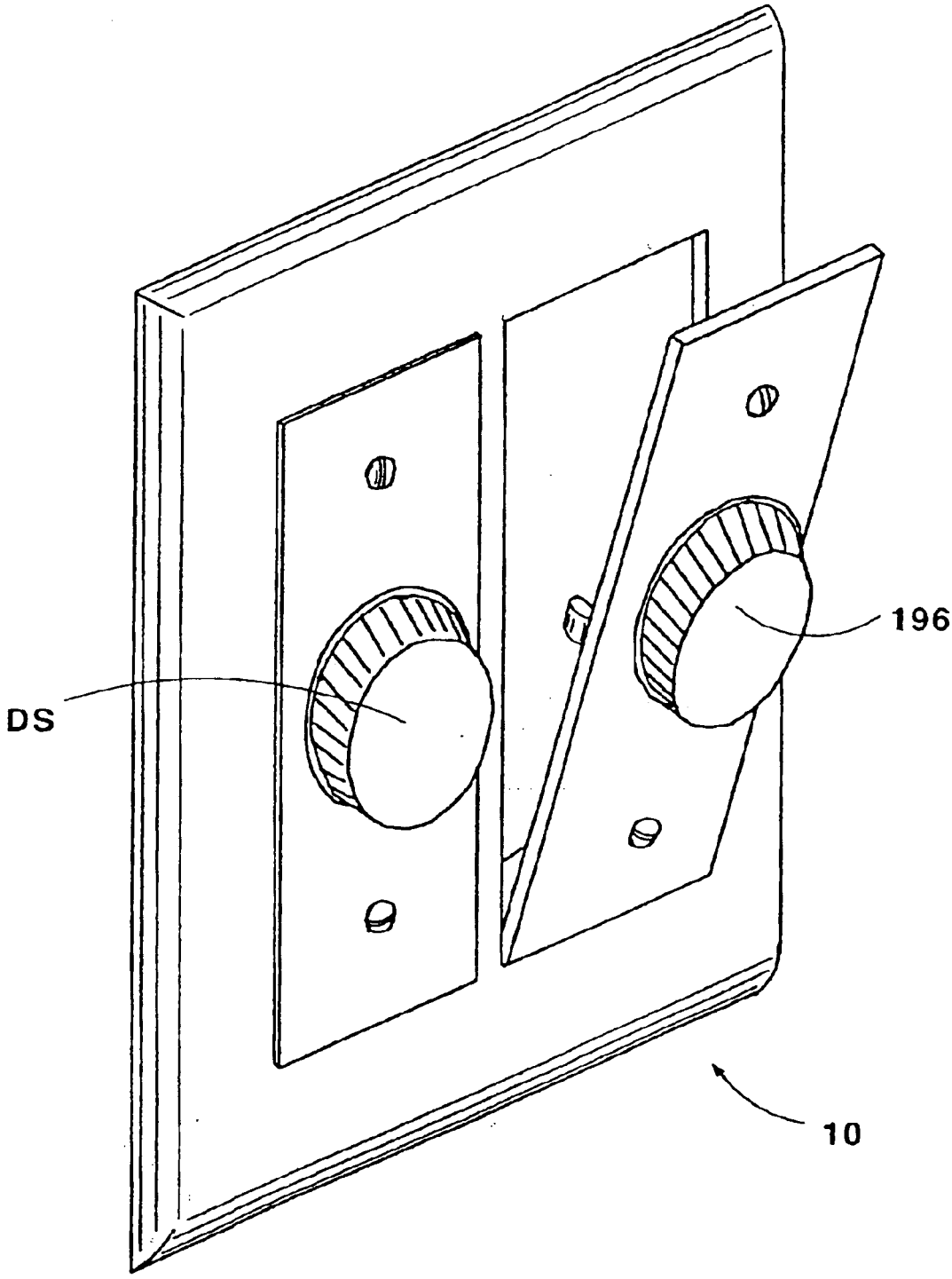
FIG. 7 is a perspective view of a key storage and concealment device according to an alternate embodiment of the present invention.

Referring now more specifically to FIG. 7, illustrated therein is an alternate embodiment of device 10, wherein the alternate embodiment of FIG. 7 is substantially equivalent in form and function to that of the preferred embodiment detailed and illustrated in FIGS. 1–5 except as hereinafter specifically referenced. Specifically, the embodiment of FIG. 7 replaces functional light switch LS and non-operative fixed light switch 96 of the preferred embodiment with functional dimmer switch DS and non-operative/non-electrically coupled dimmer switch 196, respectively, yet still maintains the overall functionality of the preferred embodiment of the present invention. It is contemplated in an alternate embodiment that device 10 could incorporate, or be incorporated within, any type of light activating member, such as, for exemplary purposes only, rocker switches, slide-dimmers, push-button, knobs, pressure-sensitive plates, touch-activated switches, and/or the like.

Figure 8:
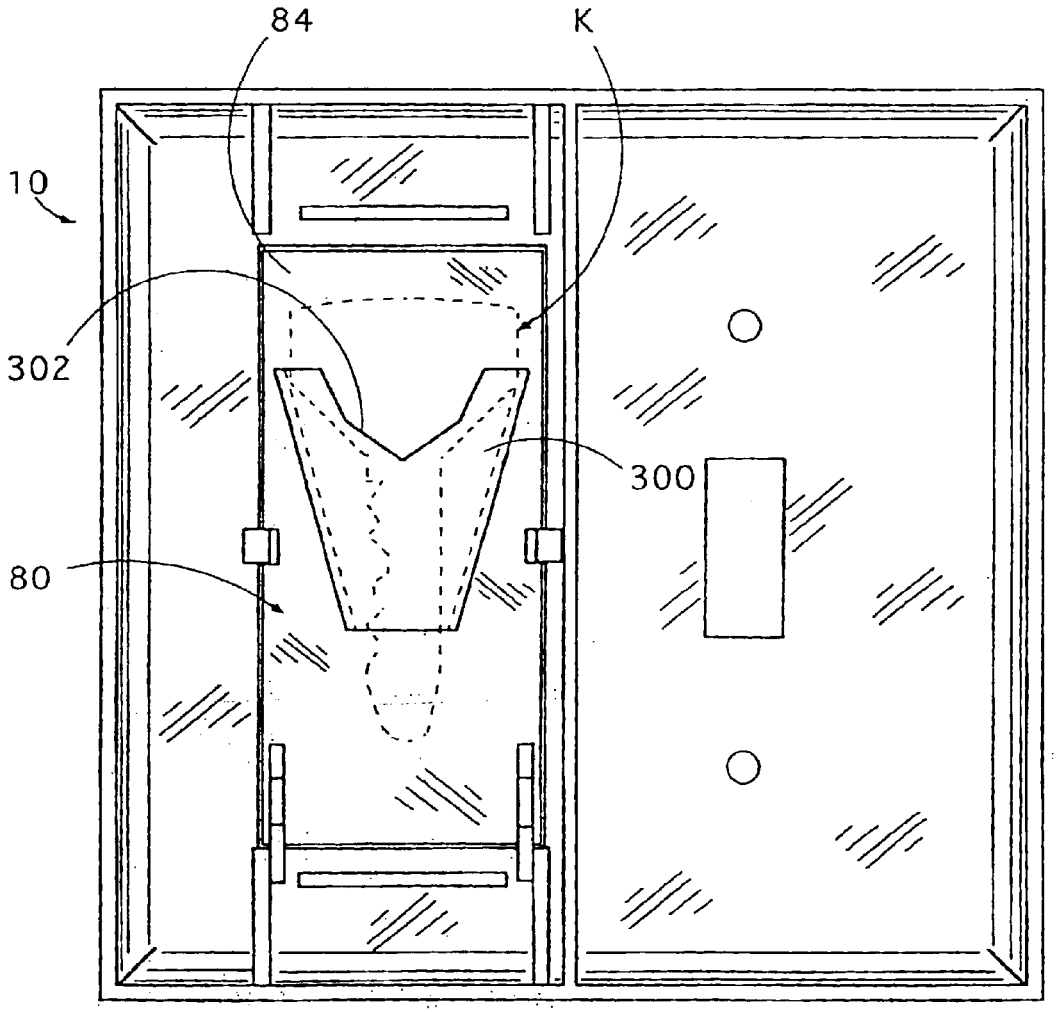
FIG. 8 is a rear view of a key storage and concealment device according to an alternate embodiment of the present invention.

Referring now more specifically to FIG. 8, illustrated therein is an alternate embodiment of device 10, wherein the alternate embodiment of FIG. 8 is substantially equivalent in form and function to that of the preferred embodiment detailed and illustrated in FIGS. 1–5 except as hereinafter specifically referenced. Specifically, the embodiment of FIG. 8 replaces retaining clasps 120, 130 with a substantially V-shaped sleeve or pocket 300 formed on rear surface 84 of hinged door 80, wherein sleeve 300 possesses a bellowed cut-away or notch 302 to facilitate the finger-grasping and removal of key K slidably engaged and retained within sleeve 300.

Figure 9A:
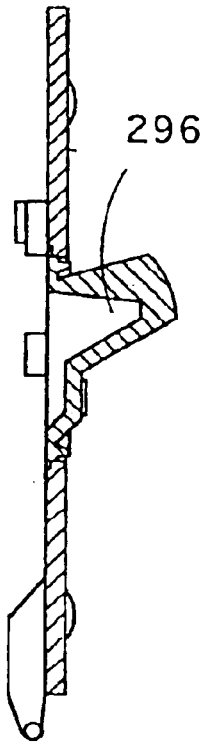
FIG. 9A is a cross-sectional view of the hinged door of a key storage and concealment device according to an alternate embodiment of the present invention.
Figure 9B:
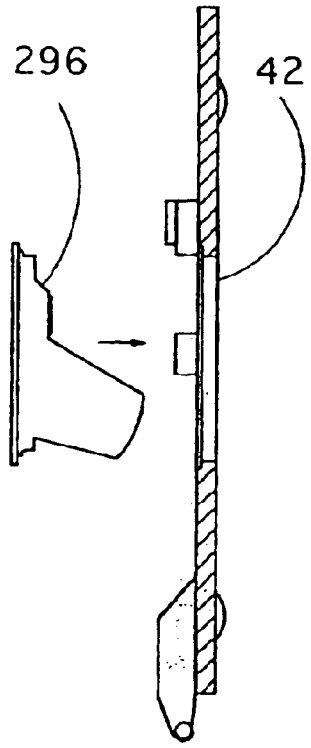
FIG. 9B is a cross-sectional view of the hinged door of a key storage and concealment device according to an alternate embodiment of the present invention; and, FIG. 9C is a rear view of the hinged door of a key storage and concealment device according to an alternate embodiment of the present invention.
Figure 9C:
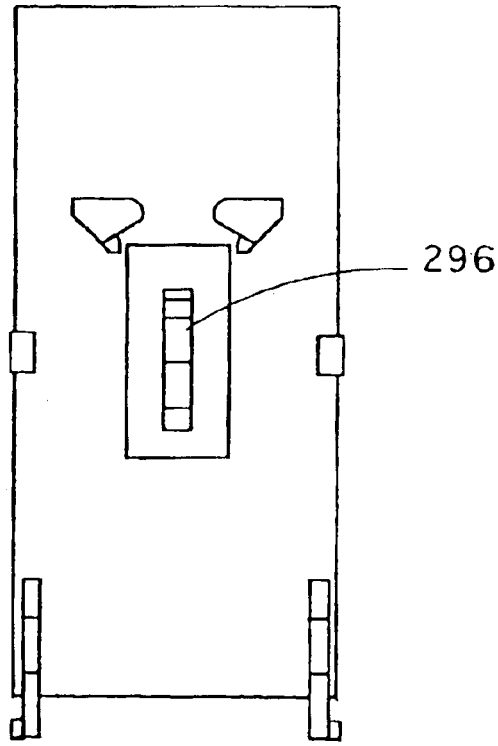

Referring now more specifically to FIGS. 9A–9C, illustrated therein is an alternate embodiment of device 10, wherein the alternate embodiment of FIGS. 9A–9C is substantially equivalent in form and function to that of the preferred embodiment detailed and illustrated in FIGS. 1–5 except as hereinafter specifically referenced. Specifically, the embodiment of FIGS. 9A–9C replaces fixed light switch 96 of the preferred embodiment, with light switch 296, wherein light switch 296 is designed to engage aperture 94 of cover plate 20 in a snap-fit fashion. As such, light switch 296 is capable of being selectively removed and inverted to permit a user to select a desired "on" or "off" position of light switch 296 within aperture 94 of cover plate 20, thereby further facilitating the inconspicuous nature of device 10.

It is contemplated in still another alternate embodiment that light switch 96 of device 10 could be pivotally engaged with aperture 94 of cover plate 20 for a more realistic and aesthetically deceptive appearance.

It is contemplated in yet another alternate embodiment that light switches 96 and 296, and dimmer 196, could be functionally operative or electrically coupled so as to permit activation of an energized source, wherein such electrical coupling could be effectuated via any suitable means as known within the art, such as, for exemplary purposes only, electrical contacts, wires, or the like.

In still another alternate embodiment, it is contemplated that device 10 could be manufactured so as to possess a plurality of hinged doors 80 for the accommodation and concealment of a plurality of keys.

In still another alternate embodiment, it is contemplated that device 10 could be manufactured so that door 80 is drawer-like.

In still another alternate embodiment, door 80 may be snapped into cover plate 20, rather than being hingedly attached thereto.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A key storage and concealment device, comprising:

a cover plate;

means for concealing a key behind said cover plate, said concealing means comprising a front surface and a rear surface, said front surface comprising a light switch lever extending therefrom; and means for retaining the key behind said concealing means and substantially against said rear surface of said concealing means, wherein at least a portion of the key is disposed directly behind and concealed by said light switch lever.

2. The key storage and concealment device of claim 1, wherein said cover plate is a light switch cover plate.

3. The key storage and concealment device of claim 1, wherein said concealing means is a hinged door in pivotal communication with said cover plate.

4. The key storage and concealment device of claim 3, wherein said retaining means is a retaining clasp formed on said rear surface of said hinged door, said retaining clasp dimensioned to receive and retain at least one key therein.

5. The key storage and concealment device of claim 3, wherein said retaining means is a sleeve formed on said rear surface of said hinged door, said sleeve dimensioned to receive and retain at least one key therein.

6. The key storage and concealment device of claim 3, wherein said light lever is a faux or electrically active light switch lever.

7. The key storage and concealment device of claim 3, wherein said hinged door is held in a closed position against said cover plate via a protuberance extending from said hinged door and adapted to engage said cover plate.

8. A key storage and concealment device, comprising:

a cover plate;

means for concealing a key behind said cover plate, said concealing means comprising a front surface and a rear surface, said front surface comprising a light switch lever extending therefrom; and, means for retaining the key substantially against said rear surface of said concealing means, wherein at least a portion of the key is concealed by said light switch lever.

9. The key storage and concealment device of claim 8, wherein said cover plate is a light switch cover plate.

10. The key storage and concealment device of claim 8, wherein said concealing means is a hinged door in pivotal communication with said cover plate.

11. The key storage and concealment device of claim 10, wherein said retaining means is a retaining clasp formed on said rear surface of said hinged door, said retaining clasp dimensioned to receive and retain at least one key therein.

12. The key storage and concealment device of claim 10, wherein said retaining means is a sleeve formed on said rear surface of said hinged door, said sleeve dimensioned to receive and retain at least one key therein.

13. The key storage and concealment device of claim 10, wherein said light switch lever is a faux or electrically active light switch lever.

14. The key storage and concealment device of claim 10, wherein said hinged door is held in a closed position against said cover plate via a protuberance extending from said hinged door and adapted to engage said cover plate.

* * * * *